US005362264A

United States Patent [19]

Parant

[11] Patent Number: 5,362,264

[45] Date of Patent: Nov. 8, 1994

[54] WATER-BICYCLE

[76] Inventor: Pierre-Louis Parant, 2573 Lalonde, Ste-Foy, G1W-1M8, Canada

[21] Appl. No.: 130,382

[22] Filed: Oct. 1, 1993

[30] Foreign Application Priority Data

Sep. 10, 1992 [CA] Canada ..... 2087736-7

[51] Int. Cl.[5] ..... B63H 16/20

[52] U.S. Cl. ..... 440/29; 440/30; 440/31

[58] Field of Search ..... 440/26, 29, 30, 31

[56] References Cited

U.S. PATENT DOCUMENTS

| | | | |
|---|---|---|---|
| 1,578,395 | 3/1926 | Chapin | 440/31 |
| 2,420,422 | 5/1947 | Gilliam | 440/31 |
| 3,272,173 | 9/1966 | Avellino | 440/29 |
| 4,474,502 | 10/1984 | Dadud | 440/29 |
| 4,511,338 | 4/1985 | Fanelli | 440/26 |

FOREIGN PATENT DOCUMENTS

| | | | |
|---|---|---|---|
| 2039493 | 9/1992 | Canada . | |
| 2535284 | 5/1984 | France | 440/26 |
| 3020873 | 1/1981 | Germany . | |
| 0671937 | 10/1989 | Switzerland | 440/26 |

*Primary Examiner*—Sherman Basinger
*Attorney, Agent, or Firm*—Robic

[57] ABSTRACT

A water bicycle comprises a flotation board, a propulsion and seat unit including a mounting flange, a seat, foot pedals mounted for rotation driven by a person sitting on the seat, a propeller and a coupling connecting the pedals to the propeller, an opening in the board through which the propeller may pass and a surrounding edge surface able to receive the flange. A connector is provided for releasably connecting the flange to the edge surface. The bicycle includes a bore in the board with a bushing seat surrounding an upper end of the bore, a handlebar unit including a shaft and a bushing provided on the shaft above a lower end of the shaft, the bushing engaging the bushing seat and the shaft being supported and rotatable in the bore, and a rudder unit connected to the handlebar shaft. A weight of the propulsion and seat unit is supported by the edge surface, and a space on the board between the handlebar unit and the propulsion and seat unit is free for climbing up on when mounting the board in deep water.

6 Claims, 4 Drawing Sheets

WATER-BICYCLE

FIELD OF THE INVENTION

The present invention relates to a water-bicycle.

1. Background of the Invention

Pedal driven aquatic vehicles or water-bicycles are known in the art. For example, U.S. Pat. No. 4,474,502 granted to Daoud shows a known structure in which a seat and pedal unit is mounted onto a surfboard. A separate handlebar unit is mounted on the surfboard forward of the seat and pedal unit. The rudder is controlled by means interconnecting the handlebar to the rudder. The user pedals to propel the vehicle forward over the water and assumes a position and control similar to a bicycle.

2. Summary of the Invention

It is therefore an object of the present invention to provide a water bicycle assembled from distinct mechanisms that can be easily transported in a car, i.e. quickly assembled and disassembled while providing for compact storage of the disassembled components. It is furthermore an object of the present invention to provide a water bicycle which provides a free space between a pedal and seat unit and a handlebar unit which can be used for pulling oneself onto the board from deep water and then for standing up.

According to the invention there is provided a water bicycle comprising an elongated flotation board having a bow and a stern, a propulsion and seat unit including a mounting flange, a seat, foot pedals, means for rotatably mounting the foot pedals for use by a person sitting on the seat, propeller means and coupling means connecting the pedals to the propeller means. An opening in the flotation board is provided through which the propeller means may pass and a surrounding edge surface of the opening is able to receive the mounting flange. Means are provided for releasably connecting the flange to the surrounding edge surface. A bore in the flotation board is provided which includes a bushing seat surrounding an upper edge of the bore. A handlebar unit includes a shaft and a bushing provided on the shaft above a lower end of the shaft, the bushing engaging the bushing seat and the shaft being supported and rotatable in the bore. The water bicycle also comprises a rudder unit including means for operatively connecting a rudder to the shaft. A weight of the propulsion and seat unit is supported by the surrounding edge surface of the opening and a space on the board between the handlebar unit and the propulsion and seat unit is free for climbing on when mounting the flotation board in deep water.

DETAILED DESCRIPTION OF THE PREFERRED EMBODIMENT

Figure 1:
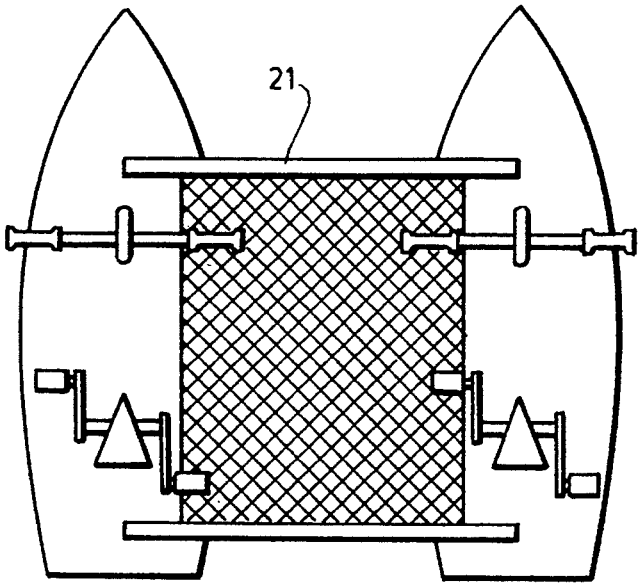
FIG. 1 is a plan view of two water bicycles interconnected by a cross member.
Figure 2:
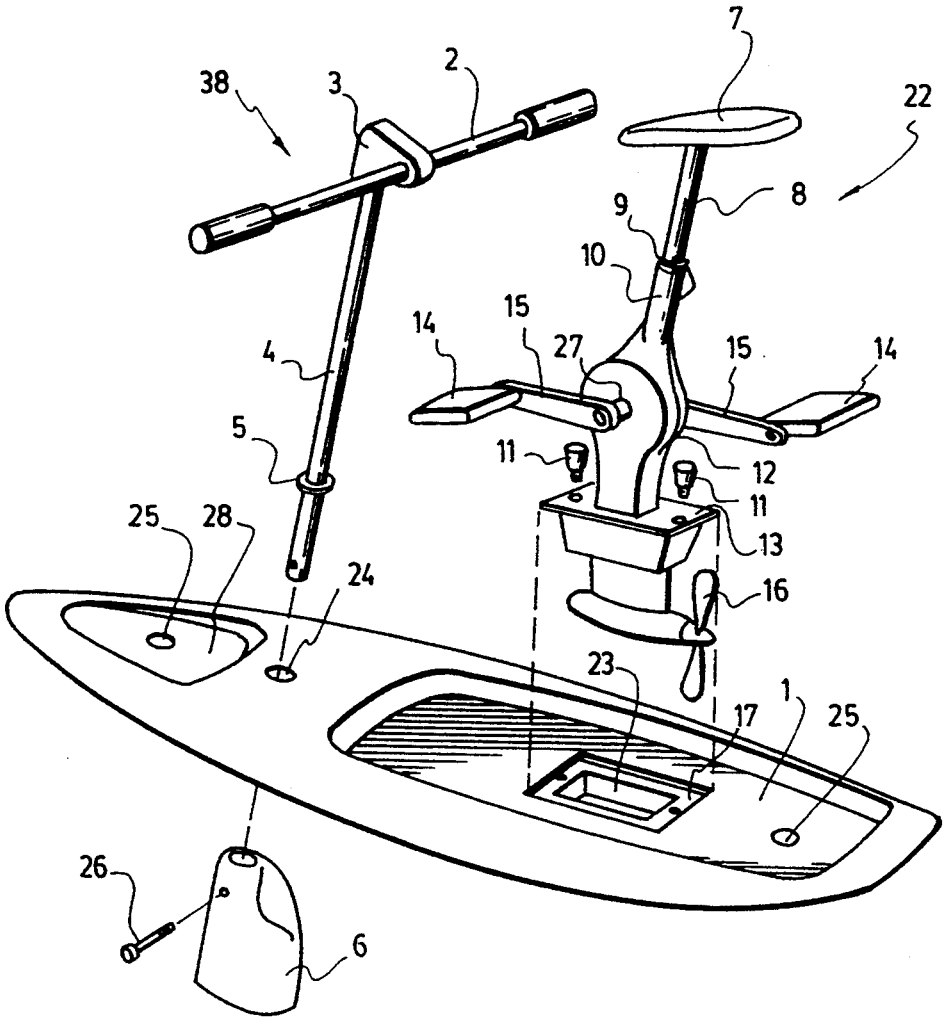
FIG. 2 shows an exploded perspective view of a preferred embodiment of the invention.
Figure 3:
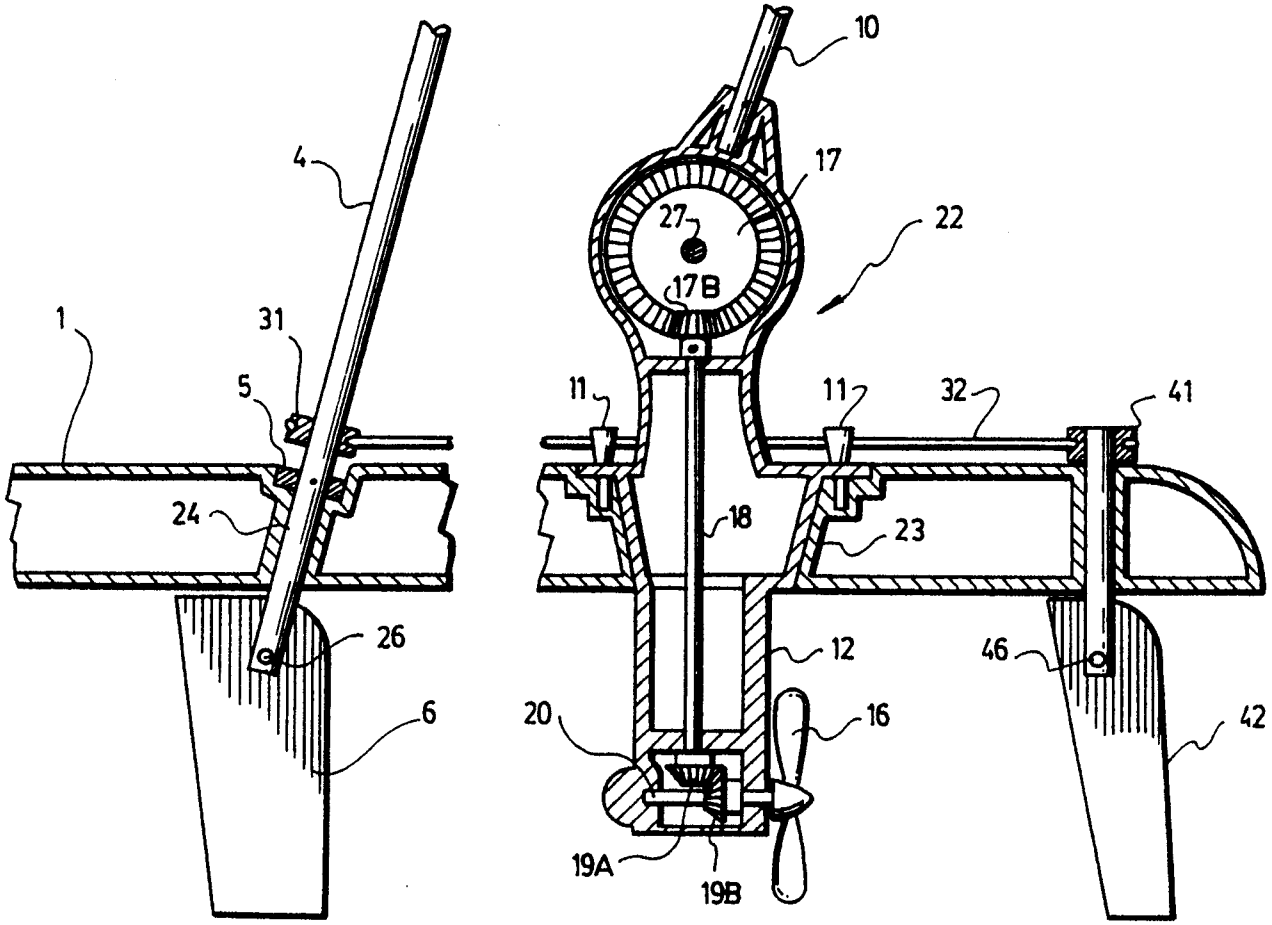
FIG. 3 is a detailed partial cross-sectional view of the propulsion unit and steering rudders.
Figure 4:
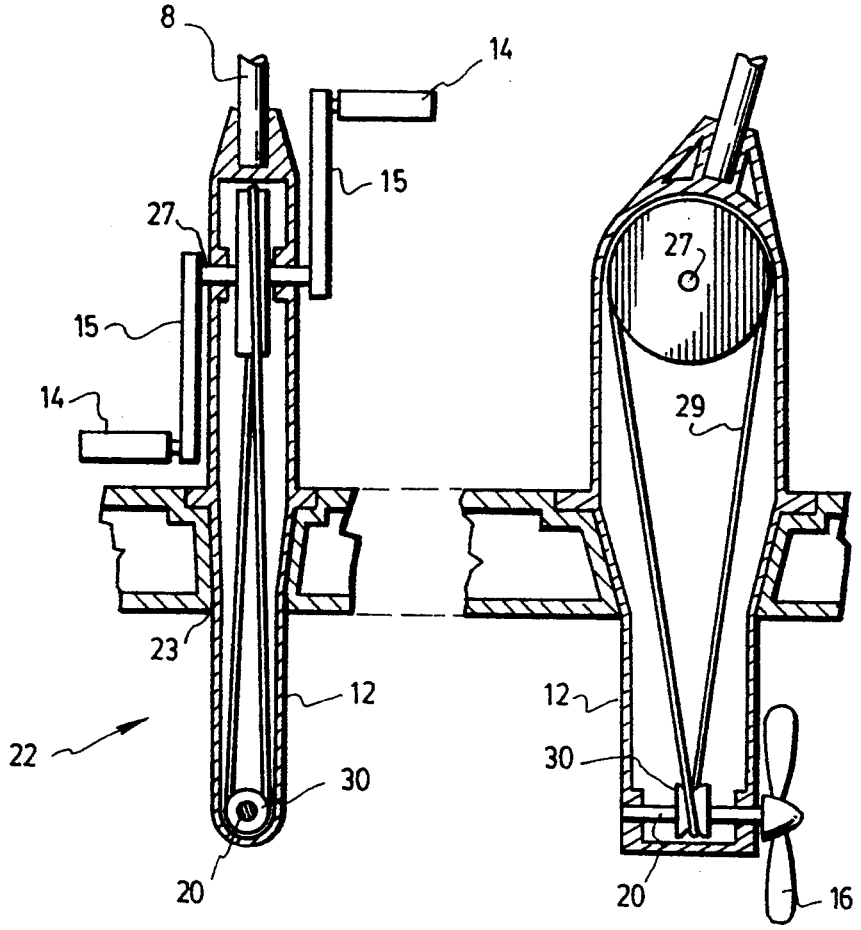
FIG. 4 shows a transverse vertical sectional view and a longitudinal vertical sectional view of a pedal driven belt drive propulsion unit.

As shown in FIG. 2, the invention comprises an elongated flotation board (1), a propulsion and seat unit (22) and a handlebar unit (38). The propulsion and seat unit (22) has a lower end passing through an opening (23) in board (1). Handlebar unit (38) has a shaft (4) with a lower end fitting into an angled bore (24) provided in flotation board (1). A rudder (6) is directly attached to a bottom end of shaft (4) using a pin (26) such that the rudder can pivot upwardly if impacted by bottom. As illustrated in FIGS. 1, 3 and 4, the propulsion and seat unit (22) includes a bicycle seat (7) attached to a sliding tube (8) for adjustment. A quick release system (9) is used to adjust and secure the sliding tube so that the seat can be adjusted in height to suit the user. Another tube (10) connects the sliding tube (9) to a housing (12). Housing (12) comprises two half shells which encase part of the foot pedal mechanism (27) and the coupling means comprising (in FIG. 3) gears (17), (17*b*), shaft (18), gears (19*a*), (19*b*) and output shaft (20). Propeller (16) is mounted on output shaft (20). In the embodiment illustrated in FIG. 4, a belt or chain (29) directly interconnects a drive sprocket or belt wheel on shaft (27) to a sprocket or belt wheel (30) on shaft (20). As shown in FIG. 2, pedals (14) are connected by levers (15) to shaft (27).

Figure 6:
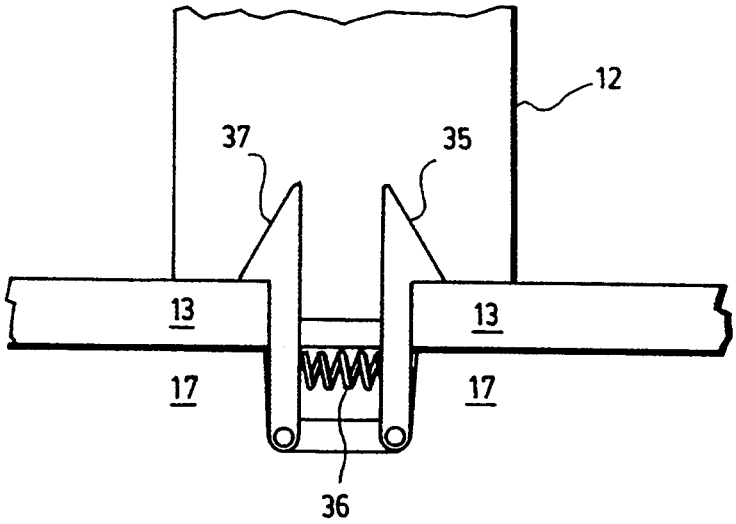
FIG. 6 illustrates a detailed view of a quick connect fastening means for the propulsion and seat unit.

Housing (12) includes an integral flange (13) which abuts against an upper edge surface (17) of opening (23) and releasable connecting means such as threaded fasteners (11) illustrated in FIG. 3 or a mechanism such as illustrated in FIG. 6 connects flange (13) to edge surface (17). The flange to edge surface connection is designed to be a perfect fit leaving almost no space between opening (23) and a submerged part of housing (12). The submerged part of housing (12) and the underside of board (1) are designed to be hydrodynamic.

As shown in FIG. 2, the handlebar unit (38) has a handlebar (2) with grips at each end, a connector (3) connecting the bar (2) to shaft (4). Bushing (5) prevents the tube from sliding down bore (24) and leaves shaft (4) free to rotate.

As can be appreciated from FIG. 2, propeller (16) is aligned to be vertical before inserting the lower portion of housing (12) and propeller (16) through opening (23).

In the embodiment shown in FIG. 1, two such water bicycle units are interconnected by a cross member (21) which plugs into bores (25) at the bow and stern ends of each flotation board (1). The cross member (21) enhances individual stability of the boards and permits two people to leisurely cruise together. The cross member (21) may also be used for storing articles to be transported, and it may include a net able to comfortably support a person for relaxation.

As illustrated in FIG. 3, additional steering control can be obtained by connecting to shaft (4) a first wheel (31) by which a steering torque is transferred to a second wheel (41) turning a rear shaft (43) connected by pin (46) to a stern rudder (42). Cable or rod (32) allows rudder (6) and rudder (42) to move simultaneously to effect an efficient turning motion.

Figure 5:
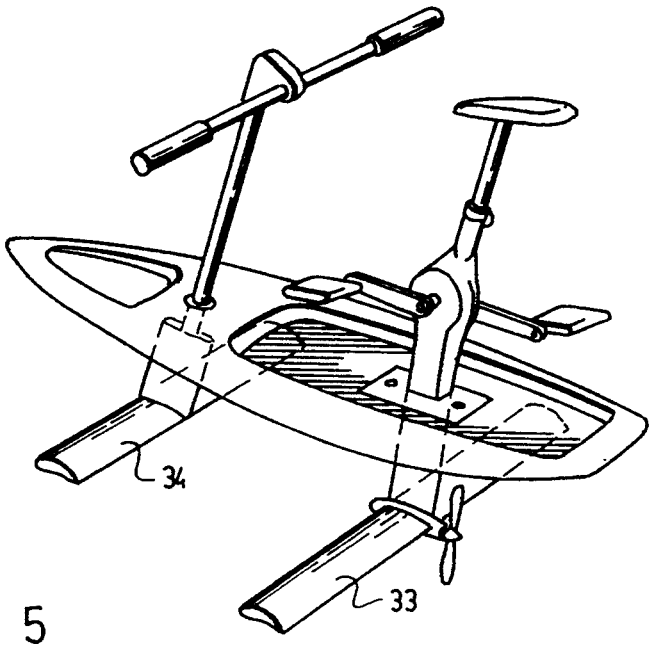
FIG. 5 shows a perspective view of the invention including hydrofoils.

In the variant illustrated in FIG. 5, hydrofoil members (34) and (33) are added to the lower projections of rudder (6) and housing (12) respectively for generating hydrodynamic lift.

FIG. 6 illustrates a snap or quick release mechanism for connecting flange (13) to edge (17). A pair of hooked tabs (35) and (37) are resiliently biassed outward by a spring (36) and passed through a notch to be provided in flange (13). As flange (13) passes over the tabs (35) and (37), they are resiliently deflected inwards until the barbs snap over the edge of flange (13).

As can be seen in FIGS. 2 and 5, a recess in flotation board (1) is provided such that pedals (14) may descend to be relatively close to a floor of board (1) whereby the propulsion and seat unit is mounted as low as possible. Recess (28) at the bow of flotation board (1) can be used for resting purposes and provides the bottom of a seat. Inclined shaft. (4) of the handlebar unit can then be used as a crude backrest of that seat. As can be appreciated, a center of gravity of the propulsion and seat unit including a person sitting on seat (7) is kept low for stability.

Although the invention has been described above with reference to a preferred embodiment and a variant as illustrated in the appended drawings, it is to be understood that other embodiments of the invention are contemplated as defined in the appended claims.

I claim:

1. A water bicycle comprising:

an elongated flotation board having a bow and a stern;

a propulsion and seat unit including a mounting flange, a seat, foot pedals, means mounting the foot pedals for use by a person sitting on said seat, propeller means and coupling means connecting said pedals to said propeller means;

means defining an opening in said board through which said propeller means may pass and a surrounding edge surface able to receive said flange;

means for releasably connecting said flange to said edge surface;

means defining a bore in said board with a bushing seat surrounding an upper end of said bore;

a handlebar unit including a shaft and a bushing provided on said shaft above a lower end of said shaft, said bushing engaging said bushing seat and said shaft being supported and rotatable in said bore; and a rudder unit including means for operatively connecting a rudder to said shaft, whereby a weight of said propulsion and seat unit is supported by said edge surface, and a space on said board between said handlebar unit and said propulsion and seat unit is free for climbing up on when mounting said board in deep water.

2. The water bicycle as claimed in claim 1, wherein said rudder unit is directly connected to said shaft by means of a connecting pin, said connecting pin allowing said rudder to be deflected upwardly upon impacting a fixed bottom object.

3. The water bicycle as claimed in claim 1, wherein said opening is elongated, said propeller means comprising a two-blade in-line propeller able to pass through said opening when oriented vertically.

4. The water bicycle as claimed in claim 1, wherein said connecting means comprise barbed tabs provided on said board for engaging an upper surface of said flange when abutting said edge surface.

5. The water bicycle as claimed in claim 1, further comprising hydrofoil means for providing lift to said water bicycle.

6. The water bicycle as claimed in claim 1, wherein said shaft is inclined, towards the stern, further comprising a seat recess at said bow of said board, whereby a user may sit on said recess using said shaft as a backrest.

* * * * *